US005542680A

United States Patent [19]

Proudfit et al.

[11] Patent Number: 5,542,680

[45] Date of Patent: Aug. 6, 1996

[54] GOLF BALL WITH CLEAR COVER

[75] Inventors: James R. Proudfit, Humboldt; Ralph Peterson, Jackson, both of Tenn.

[73] Assignee: Wilson Sporting Goods Co., Chicago, Ill.

[21] Appl. No.: 369,675

[22] Filed: Jan. 17, 1996

[51] Int. Cl.[6] ..... A63B 37/12

[52] U.S. Cl. ..... 473/378; 40/327

[58] Field of Search ..... 273/235 R, 213; 40/327

[56] References Cited

U.S. PATENT DOCUMENTS

| | | | |
|---|---|---|---|
| 1,622,421 | 3/1927 | Coffield | 273/235 R |
| 2,050,402 | 8/1936 | Walsh | 273/62 |
| 2,600,856 | 6/1952 | Decepoli | 273/DIG. 14 |
| 3,313,545 | 4/1967 | Bartsch | 273/218 |
| 4,679,794 | 7/1987 | Yamada | 273/235 R |
| 4,679,795 | 7/1987 | Melvin | 273/235 R |
| 4,798,386 | 1/1989 | Berard | 273/235 R |
| 4,865,326 | 9/1989 | Isaac | 273/235 A |
| 4,998,734 | 3/1991 | Meyer | 273/235 R |
| 5,000,458 | 3/1991 | Proudfit | 273/235 A |
| 5,018,742 | 5/1991 | Isaac | 273/235 A |
| 5,029,870 | 7/1991 | Concepcion | 273/235 A |
| 5,255,922 | 10/1993 | Proudfit | 273/235 R |

FOREIGN PATENT DOCUMENTS

| | | | |
|---|---|---|---|
| 924877 | 5/1963 | United Kingdom | 273/235 R |

*Primary Examiner*—George J. Marlo

[57] ABSTRACT

A golf ball is provided with a substantially clear cover so that the core of the ball is visible through the cover. The core is preferably formed from a blend of ionomer resins which have different metal cations but substantially the same acid content. The core may be printed with indicia such as a logo or stripes which are visible through the clear cover. The core may also be colored by pigment which is included in the core or by a coat of pigmented paint. One or more clear top coats can be applied to the cover. A used ball can be recycled without stripping the top coat by abrading the outer surface of the ball and applying a fresh top coat. Extended range ball use is possible because the logo stays intact indefinitely.

11 Claims, 1 Drawing Sheet

GOLF BALL WITH CLEAR COVER

BACKGROUND

This invention relates to golf balls, and, more particularly, to a golf ball with a clear cover.

Golf balls generally include a core and a cover. Golf balls which are currently available fall into two general categories—balls which include a balata cover and balls which include a more durable, cut resistant cover.

Most cut-resistant covers utilize Surlyn ionomer resins, which are ionic copolymers available from E.I. du Pont de Nemours & Co. Surlyn ionomers are copolymers of an olefin, typically ethylene, and an alpha-beta ethylenically unsaturated carboxylic acid, such as methacrylic acid. Neutralization of a number of the acid groups is effected with metal ions, such as sodium, zinc, lithium, and magnesium. DuPont's U.S. Pat. No. 3,264,272 describes procedures for manufacturing ionic copolymers and is incorporated herein by reference.

Other cut-resistant materials which can be used in golf ball covers are ionic copolymers or ionomers available from Exxon under the name Iotek, which are similar to Surlyn ionomers except that acrylic acid is used rather than methacrylic acid.

The cover of a conventional golf ball is opaque. Most covers are white, which is generally obtained by incorporating a white pigment such as titanium dioxide in the cover material. Colored golf balls have also been sold, and the color may be obtained by incorporating pigment or dye in the cover material.

Indicia such as a logo and a number can be imprinted on the cover, and one or more clear coats can be applied over the printed cover. For example, as described in U.S. Pat. No. 5,000,458, the cover can be coated with a transparent primer coat and an outermost clear coat or finish coat.

U.S. Pat. No. 4,798,386 describes a ball having a white core and transparent cover, which includes fluorescent material. FIG. 1 illustrates indicia 18 affixed to the core which is visible through the transparent cover.

Range balls which are used on driving ranges usually include a colored stripe which is painted on the surface of the cover, or the cover may be completely covered with a coating of colored paint.

When indicia such as a logo, number, stripes, etc. are applied to the cover of a golf ball, the indicia can be worn or abraded as the golf ball is used. The appearance of the golf ball is adversely affected.

Some used golf balls are recycled to improve their appearance. Range balls in particular might be recycled in order to reduce the cost of buying new balls. The recycling process generally includes using a caustic stripper solution which is used to soften and break down the urethane clear coatings on the ball. The stripper solution can present health and safety problems during use, and disposal of the solution can cause environmental problems. It would be desirable to recycle golf balls without using stripper solutions.

SUMMARY OF THE INVENTION

The invention provides a golf ball having a clear, transparent cover. The cover is preferably essentially free of pigment or dye so that the cover is substantially clear or transparent. The core of the ball may be imprinted with desirable indicia such as a logo, a number, and/or stripes.

Alternatively or in addition, the core can be provided with a color either by incorporating pigment or dye in the core or by covering the core with a colored coating. One or more clear coatings can be applied to the cover if desired.

The core and any printing on the core are clearly visible through the cover. The cover protects the core and the printing, and the core and printing are clearly visible even after the cover is severely worn or abraded.

Since the printing and/or the color of the core is protected by the cover, the ball can be recycled without having to strip the outer coatings and reprint the cover. The used ball is recycled by rubbing the ball, for example, in a roto tub with a stone media, to remove minor scrapes, abrasions, debris, etc. The ball is then dried and recoated with one or more top coats. If desired, a ball can be recycled several times. This process development is not presently in use but is a significant part of the new approach we have developed.

DESCRIPTION OF THE DRAWING

The drawing will be explained in conjunction with illustrative embodiments shown in the accompanying drawing, in which.

DESCRIPTION OF SPECIFIC EMBODIMENT

Figure 1:
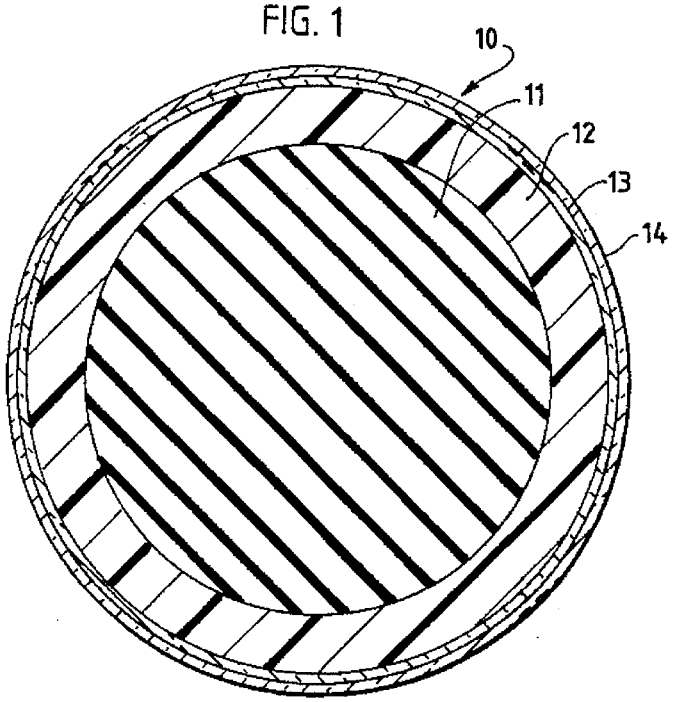
FIG. 1 is a cross sectional view of a golf ball which is formed in accordance with the invention.

Referring to FIG. 1, a golf ball 10 includes a core 11 and a cover 12. The cover is coated with a transparent primer coat 13 and an outermost clear coat or finish coat 14. The core 11 is preferably a solid molded core. The core may include pigment or dye to provide color, or the core can be covered with a layer of paint or other pigmented coating. A white core can be obtained by incorporating titanium dioxide in the core. A colored core, for example, yellow, can be obtained by incorporating yellow pigment in the core.

Figure 2:
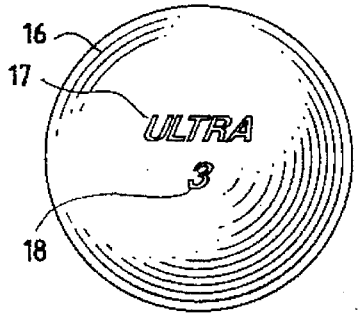
FIG. 2 illustrates a core with a logo and a number before the cover is applied.

The core 16 shown in FIG. 2 is imprinted with a logo 17 and an identifying number 18. The core can be a conventional core for a solid or two-piece golf ball or a conventional core for a range ball. The logo and number can be imprinted on the core in the same manner which is used to imprint covers of golf balls.

Figure 3:
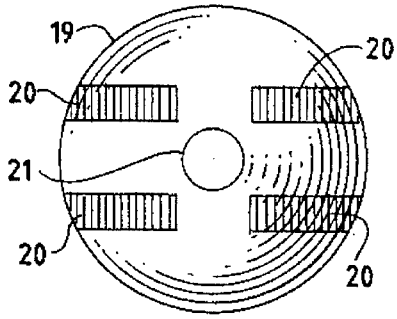
FIG. 3 illustrates a core for a range ball before the cover is applied.

The core 19 shown in FIG. 3 is intended for use as a range ball. Stripes 20 are imprinted or painted on the core. A logo 21 or corporate advertising, etc. can also be imprinted on the core.

The cover 12 is preferably formed from ionomer resins such as Surlyn or Iotek resins. The cover can be injection molded about the core or can be formed from two hemispherical half shells which are compression molded about the core. Suitable dimples are molded into the cover during the molding operation either by compression molding or direct injection molding.

One or more clear coatings can be applied to the cover. For example, as described in U.S. Pat. No. 5,000,458, a primer coat 13 may be a waterborne epoxy/acrylic/urethane resin system and may include an optical brightener. The primer coat may also be a solvent-based system with or without an optical brightener. Thirdly, the primer coat may be a U.V. curable coating system. Specific optical brighteners are identified in the patent.

The outermost clear coat 14 may consist of a solvent two-component urethane paint system as described in U.S. Pat. No. 5,000,458. The outermost clear coat 14 may be a waterborne resin system or a U.V. curable system.

The color of the core and the logos, identifying number, stripes, advertising, etc. on the core are clearly visible through the transparent cover and the clear coats. The core and the indicia thereon are protected from wear and abrasion by the cover, and the core and indicia remain clear and legible even after the outer coatings and the cover are severely abraded.

Individual Surlyn ionomer resins are generally clear and transparent. However, it is conventional to make golf ball covers from a blend of ionomer resins which are neutralized with different metal cations. For example, blends of two or more ionomers selected from sodium ionomers, zinc ionomers, and lithium ionomers have been used. However, we have discovered that if two or more ionomer resins are selected to provide optimum coefficient of restitution, distance, or durability, the blend of resins is often cloudy and not optically clear. In order to maximize the clarity of the blend of ionomer resins, it is advantageous to use resins which have essentially the same or similar percentage acid content. As described in U.S. Pat. No. 3,264,272, the percentage of the carboxylic acid in the copolymer can be varied.

We have found, for example, that a 75/25 blend of zinc Surlyn 9910 and sodium Surlyn 8527 will produce a milky rather than a clear cover. The ratio 75/25 refers to a blend of 75% Surlyn 9910 and 25% Surlyn 8527, the percentages being based on the total polymer content. Zinc Surlyn 9910 has a 15% acid content, and sodium Surlyn 8527 has a 10% acid content.

The preferred cover blend is 75% Surlyn 9520 and 25% Surlyn 8527. Surlyn 9520 is a zinc Surlyn and Surlyn 8527 is a sodium Surlyn. Both Surlyns have a 10% acid content. However, other blend ratios, other Surlyns, and other acid contents can be used, for example, 15% or 20% acid content.

The cover is preferably substantially clear or transparent. The clarity or transparency of the cover material can be defined by the amount of light which is transmitted through the cover material.

For the purpose of measuring and comparing light transmission, the following cover compositions were prepared based upon parts by weight:

| Ingredient | EXG45-1 | EXG45-11 | EXG45-12 | EXG45-13 |
|---|---|---|---|---|
| Surlyn 8527 | 25.00 | 25.00 | 18.75 | 12.50 |
| Surlyn 9520 | 75.00 | 75.00 | 56.25 | 37.50 |
| Concentrate # 37302-R1 | — | 8.00 | 8.00 | 8.00 |
| Concentrate # 7554-A1 | — | — | 25.00 | 50.00 |
| Total | 100.00 | 108.00 | 108.00 | 108.00 |

The two concentrates were supplied by Americhem, 2038 Main Street, Cuyohoga Falls, Ohio. We do not know the exact composition of the concentrates, but Concentrate #37302-R1 is a U.V. stabilizer package to improve color aging and prevent yellowing or discoloring caused by ultraviolet light, etc. Concentrate #37302-R1 uses Surlyn 8940 as a base carrier resin and is referred to in the industry genericaly as a HALS (Hindered Anine Light Stabilizer) and Antioxidant. Surlyn 8940 is a sodium Surlyn.

We believe that cover composition EXG45-11 will be the preferred cover composition because of the inclusion of the HALS and Antioxidant.

Concentrate #7554-A1 is a concentrate which includes barium sulfate and was included in EXG45-12 and EXG45-13 to illustrate the dulling effect and reduced light transmission provided by barium sulfate. Increasing the amount of barium sulfate increases the opacity of the cover.

Figure 4:
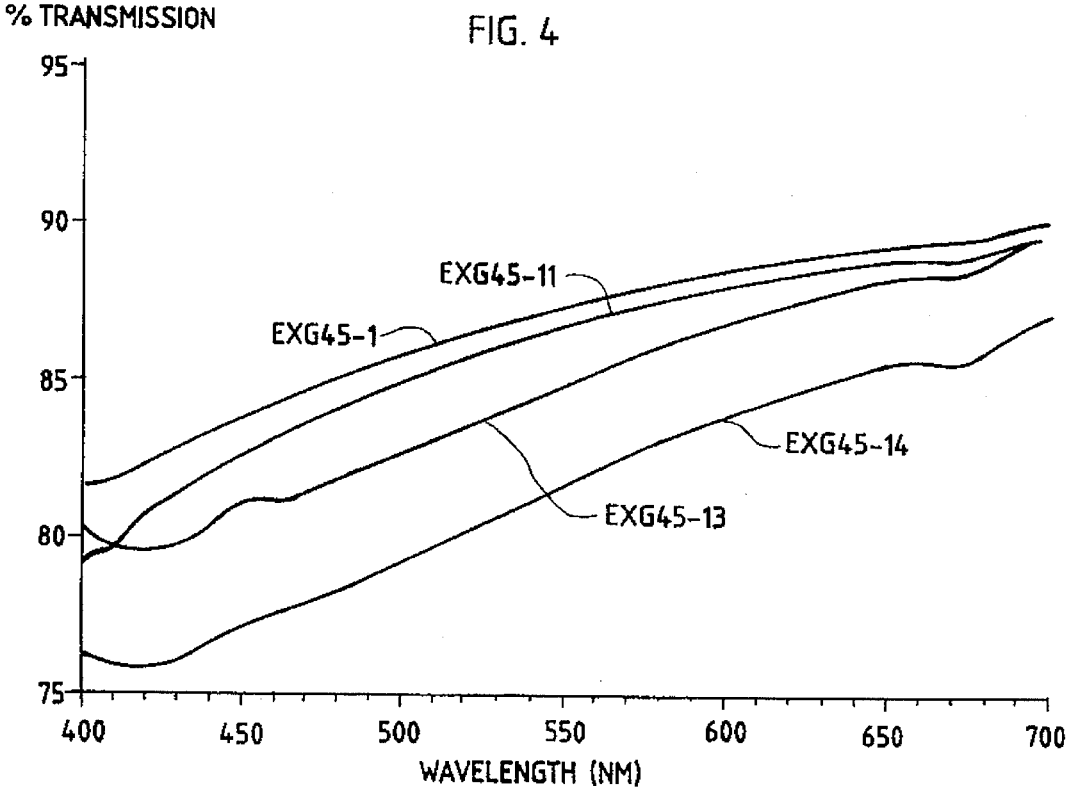
FIG. 4 illustrates light transmission curves for various cover materials.

FIG. 4 illustrates the light transmission through plaques of the four cover compositions. Each plaque was about 0.125 inch thick. The range of wavelength of 400 nm to 700 nm approximates the wavelength range of visible light.

The EXG45-1 plaque transmitted about 82% of the light at 400 nm, more than 87% at 550 nm, and about 90% at 700 nm. Including the U.V. stabilizer package in EXG45-11 does not significantly reduce the light transmission. The light transmission is slightly greater than 80% at 400 nm, about 87% at 550 nm, and about 89.5% at 700 nm.

The light transmission of the EXG45-12 placque was close to that of EXG45-11 at 400 nm and 700 nm but was less than 85% at 550 nm. The EXG45-12 material is noticeably duller than EXG45-1 and EXG45-11.

Cover material which is 0.125 inch thick preferably has a light transmission of at least about 79% throughout the entire visible range of 400 nm to 700 nm. More preferably, it has a transmission of at least about 79% at 400 nm and at least about 85% between 550 nm and 700 nm. Most preferably, it has a light transmission of greater than 85% between 550 nm and 700 nm. Unless otherwise indicated, the words "substantially clear" as used herein and in the claims refers to material which has the foregoing light transmission properties for 0.125 inch thick plaques.

The cover may contain optical brighteners, U.V. absorbers, HALS, antioxidants, Ultramarine, Blue, and other conventional ingredients of golf ball covers. However, the cover is essentially free of $TiO_2$ or other pigments or dyes which adversely affect the optical transparency of the cover. The words "essentially free" refer to the absence of an amount of pigment or dye which cause the light transmission of the cover to fall below the foregoing lower limits.

It is important for best performance properties to match the core and cover for flexibility properties. Initial testing of the foregoing cover blend indicates that a 1.520 inch diameter core is the desired size for maximum ball durability under ambient and frozen conditions. For a core having a diameter of 1.520 inch, the cover is 0.080 inch thick to provide a ball diameter of 1.680 inch, which is the minimum approved USGA diameter. It will be understood, however, that other diameters for the core and other thicknesses of the cover can be used, and the outside diameter of the ball can also exceed 1.680 inch or be less than 1.680 since range balls are not controlled or governed by USGA.

Clear covers can also be formed from materials other than ionomer resins. For example, polyethylene, polypropylene, certain TPE's, EVA, etc. can be used.

The process for manufacturing two-piece golf balls in accordance with the invention can be compared with the conventional process as follows:

Existing Process—2 Piece Ball

1. Mix core rubber compound.
2. Mill core compound and preform into slugs.
3. Mold core.
4. Centerless grind core to size.

5. Injection mold Surlyn cover around core.
6. Seam buff ball.
7. Vibratory finish ball.
8. Apply paint primer.
9. Pad print logo.
10. Apply clear top coat.
11. Apply second top coat.
12. Inspect and package.

New Process for Manufacture of Clear Cover—2 Piece Balls

1. Mix core rubber compound, (Pigmented or un-pigmented).
2. Mill core compound and preform into slugs.
3. Mold core.
4. Centerless grind to size.
5.a. Pigmented core—pad print directly on core, (Can be single or multi color logos).
5.b. Un-pigmented core—Paint core with pigmented paint, (Could have color enhancers such as pigments, dyes, aluminum flakes, pearlescense, optic brighteners, organic or inorganic colorants, etc.).
6. Un-pigmented/painted core—pad print on primed surface.
7. Injection or compression mold Surlyn cover.
8. Seam buff ball.
9. Vibratory finish ball.
10. Apply paint primer.

Note: The primer/finish top coat process could be automatically tied in together to allow for automation of the present painting process. Presently the balls have to be hand loaded on to paint spindles to prevent ink transfer from ball to ball.

11. Apply clear top coat.
12. Inspect and package.

In golf balls made in accordance with the invention the color of the core and any indicia of the core are protected by the cover. Used golf balls can therefore be recycled in a simple, economical and environmentally sound manner without stripping the primer and finish coats from the cover. Instead, minor scrapes and abrasions in the top coats and cover are simply smoothed or lightly abraded, and new top coats are applied. The recycled ball has a good, almost new appearance, and the core and indicia on the core are clearly visible. Any major defect or core/cover damage can also be visibly detected and can be sorted out.

The recycling process in accordance with the invention can be compared with a conventional recycling process as follows:

PRESENT RECYCLING PROCESS

Balls must be thoroughly cleaned and dried. They are then placed into a caustic stripper solution which is used to soften and breakdown the urethane coatings sprayed on the ball used to protect from abrasion and wear as well as protect the logo stamping on the ball.

The stripper solution is a combination of sodium hydroxide, xylol, methanol and 2-butoxy ethanol. This solution if not properly and carefully used presents both fire and potential health problems. Both vapor and or skin contact can cause acute and chronic dermatitis reactions as well as respiratory burns or irritations. Disposal is also an environmental problem.

The balls must be agitated, flushed clean and brushed to remove softened coating material. The ball must then go through the roto stone process plus the entire coating and logo process namely primer coat, dry, logo stamp, dry, topcoat (1), topcoat (2).

(This has a detrimental effect on the Surlyn cover as well)

NEW RECYCLING PROCESS

Ball is cleaned of heavy debris with a commercial ball washer and then placed into a roto tub which vibrates the balls through a stone media. This process removes minor scrapes, abrasions, debris, etc. The ball is then dried and recoated with topcoats only. The ball has a near new appearance without the cost or hazards of the caustic stripper solution. Environmentally the process is far more desirable and less expensive and the finished product is of higher quality and appearance. The new recycling process smooths the outer surface of the ball mechanically without using any chemical or solvent treatment.

The recycling process can be used on range balls up to about four times, thereby substantially increasing the useful life of the balls in a safe, economic manner.

After two or three recyclings, a remold process could be incorporated to redefine the dimples of the ball to reestablish optimum ball flight.

Stamping logos, identification markings, and/or range ball identification on the core rather than on the cover also reduces the possibility that markings will be improperly stripped from balls and replaced with unauthorized markings.

While in the foregoing specification, a detailed description of a specific embodiment of the invention was set forth for the purpose of illustration, it will be understood that many of the details herein given may be varied considerably by those skilled in the art without departing from the spirit and scope of the invention.

We claim:

1. A golf ball comprising:

a core having visible indicia printed thereon, and a substantially clear and transparent cover over the core, the core and indicia being clearly visible through the cover, the cover comprising a blend of two ionomers having two different metal cations, each of the ionomers having substantially the same percentage acid content.

2. The golf ball of claim 1 in which the core contains a pigment which provides the core with a color which is visible through the cover.

3. The golf ball of claim 1 in which the core has a coating of pigmented paint and the indicia is printed on the paint.

4. The golf ball of claim 1 in which the cover is a blend of a sodium ionomer and a zinc ionomer, each of the ionomers having substantially the same percentage acid content.

5. The golf ball of claim 1 in which the cover is a blend of 75% of a zinc ionomer having a 10% acid content and 25% of a sodium ionomer having a 10% acid content.

6. The golf ball of claim 1 including at least one clear top coat over the cover.

7. The golf ball of claim 1 in which the light transmission of the cover is such that a plaque of cover material having a thickness of 0.125 inch has a light transmission of at least about 79% for wavelengths between 400 nm and 700 nm.

8. The golf ball of claim 7 in which the light transmission of said plaque of cover material is at least about 85% for wavelengths between 400 nm and 700 nm.

9. The golf ball of claim 1 in which the percentage acid content of each of the ionomers is 10%.

10. The golf ball of claim 1 in which the percentage acid content of each of the ionomers is 15%.

11. The golf ball of claim 1 in which the percentage acid content of each of the ionomers is 20%.

* * * * *

UNITED STATES PATENT AND TRADEMARK OFFICE

CERTIFICATE OF CORRECTION

PATENT NO. : 5,542,680

DATED : August 6, 1996

INVENTOR(S) : James R. Proudfit et al

It is certified that error appears in the above-indentified patent and that said Letters Patent is hereby corrected as shown below:

Title page:

Item [22]: change "Filed Jan. 17, 1996" to --Filed Jan. 17, 1995--.

Signed and Sealed this

Fifth Day of November, 1996

Bruce Lehman

*Attest:*

BRUCE LEHMAN

*Attesting Officer*

*Commissioner of Patents and Trademarks*